US009221247B2

(12) United States Patent
Cruz-Uribe et al.

(10) Patent No.: US 9,221,247 B2
(45) Date of Patent: Dec. 29, 2015

(54) PIEZOELECTRIC INKJET DIE STACK

(75) Inventors: Tony S. Cruz-Uribe, Independence, OR (US); Joseph E. Scheffelin, Poway, CA (US); Tsuyoshi Yamashita, Corvallis, OR (US); Silam J. Choy, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/117,053

(22) PCT Filed: Jun. 29, 2011

(86) PCT No.: PCT/US2011/042265

§ 371 (c)(1), (2), (4) Date: Nov. 12, 2013

(87) PCT Pub. No.: WO2013/002774

PCT Pub. Date: Jan. 3, 2013

(65) Prior Publication Data

US 2014/0192118 A1 Jul. 10, 2014

(51) Int. Cl.

| | |
|---|---|
| ***B41J 2/045*** | (2006.01) |
| ***B41J 2/175*** | (2006.01) |
| ***B41J 2/14*** | (2006.01) |

(52) U.S. Cl.

CPC ..... *B41J 2/045* (2013.01); *B41J 2/14233* (2013.01); *B41J 2202/11* (2013.01); *B41J 2202/12* (2013.01); *B41J 2202/20* (2013.01)

(58) Field of Classification Search

None

See application file for complete search history.

(56) References Cited

U.S. PATENT DOCUMENTS

| | | | | |
|---|---|---|---|---|
| 5,406,318 | A | 4/1995 | Moore et al. | |
| 6,142,614 | A * | 11/2000 | Hashizume et al. | 347/70 |
| 6,575,562 | B1 * | 6/2003 | Anderson et al. | 347/58 |
| 7,290,857 | B2 | 11/2007 | Silverbrook | |
| 7,843,046 | B2 | 11/2010 | Andrews et al. | |
| 2003/0210303 | A1 | 11/2003 | Watase et al. | |
| 2006/0071959 | A1 * | 4/2006 | Ito et al. | 347/9 |
| 2008/0055370 | A1 | 3/2008 | Sakamoto et al. | |
| 2008/0238980 | A1 * | 10/2008 | Nagashima et al. | 347/17 |
| 2008/0277959 | A1 * | 11/2008 | Boddie et al. | 296/39.2 |
| 2009/0213182 | A1 | 8/2009 | Yamanaka | |
| 2009/0309911 | A1 | 12/2009 | Kim | |
| 2011/0037159 | A1 | 2/2011 | McElrea et al. | |
| 2011/0141203 | A1 * | 6/2011 | Gerner et al. | 347/71 |
| 2011/0148991 | A1 * | 6/2011 | Miyazawa et al. | 347/68 |

FOREIGN PATENT DOCUMENTS

| | | |
|---|---|---|
| JP | H11-207973 | 8/1999 |
| JP | 2001162794 | 6/2001 |
| JP | 2006103117 | 4/2006 |
| JP | 2007076129 | 3/2007 |
| JP | 2008-149594 | 7/2008 |
| KR | 20050016117 | 2/2005 |
| TW | I228842 | 3/2005 |

* cited by examiner

*Primary Examiner* — Matthew Luu

(74) *Attorney, Agent, or Firm* — Hewlett-Packard Patent Department

(57) ABSTRACT

A piezoelectric inkjet die stack includes a circuit die stacked on a substrate die, a piezoelectric actuator die stacked on the circuit die, and a cap die stacked on the piezoelectric actuator die. Each die in succession from the circuit die to the cap die is narrower than the previous die.

20 Claims, 7 Drawing Sheets

PIEZOELECTRIC INKJET DIE STACK

BACKGROUND

Drop-on-demand inkjet printers are commonly categorized according to one of two mechanisms of drop formation within an inkjet printhead. Thermal bubble inkjet printers use thermal inkjet printheads with heating element actuators that vaporize ink (or other fluid) inside ink-filled chambers to create bubbles that force ink droplets out of the printhead nozzles. Piezoelectric inkjet printers use piezoelectric inkjet printheads with piezoelectric ceramic actuators that generate pressure pulses inside ink-filled chambers to force droplets of ink (or other fluid) out of the printhead nozzles.

Piezoelectric inkjet printheads are favored over thermal inkjet printheads when using jettable fluids whose higher viscosity and/or chemical composition prohibit the use of thermal inkjet printheads, such as UV curable printing inks. Thermal inkjet printheads are limited to jettable fluids whose formulations can withstand boiling temperature without experiencing mechanical or chemical degradation. Because piezoelectric printheads use electromechanical displacement (not steam bubbles) to create pressure that forces ink droplets out of nozzles, piezoelectric printheads can accommodate a wider selection of jettable materials. Accordingly, piezoelectric printheads are utilized to print on a wider variety of media.

Piezoelectric inkjet printheads are commonly formed of multilayer stacks. Ongoing efforts to improve piezoelectric inkjet printheads involve reducing fabrication and material costs of piezoelectric stacks while increasing their performance and robustness.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
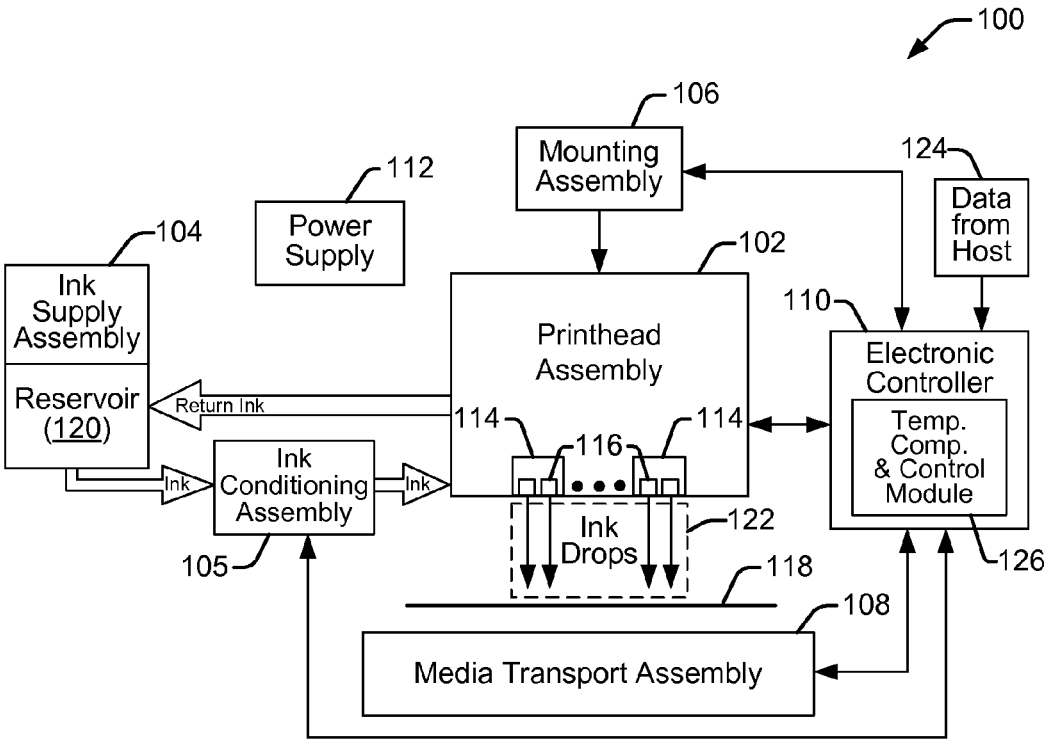
FIG. 1 shows a fluid ejection device embodied as an inkjet printing system suitable for incorporating a fluid ejection assembly having a piezoelectric die stack as disclosed herein, according to an embodiment.

As noted above, improving piezoelectric inkjet printheads can involve developing cheaper, higher performing and more robust silicon die stacks. As part of this ongoing trend, multiple silicon die are increasingly used for many of the layers in the stack since finer, more densely packed features can be etched into silicon. Various issues in the development of silicon die stacks include the proper vertical alignment of features such as manifold compliances, drive electronics, and multiple ink feeds to the pressure chambers. Other issues include reducing the length and improving the yield of electrical interconnections between die and external signal cables. Reducing the high cost of certain die in the stack is an ongoing challenge.

Previous attempts to improve piezoelectric inkjet printheads include the use of die stack designs having wire bonds attached to die backsides, die slots for passing drive wires between die layers, fluidics routed around rather than through die layers, variously-shaped and same-shaped die within the die stack, and control circuit die that are near but not integrated into the die stack.

Embodiments of the present disclosure address these issues through a piezoelectric drop ejector (printhead) that includes a multilayer MEMS die stack having a thin film piezoelectric actuator and drive circuitry. Each die in the stack is narrower than the die below, to enable straightforward alignment and interconnection during assembly. This facilitates proper matching of manifold compliances, drive electronics, multiple ink feeds, and so on, to opposing features on adjacent die. The die stack design additionally reduces the widths of the more expensive layers in the stack such as the piezoelectric actuator die and nozzle plate, which results in reduced costs. The die stack design allows the piezo-actuator to be located on the same side of the pressure chamber as the nozzle. This in turn allows for chamber ink inlets and outlets to be directly below the chamber, enabling shorter chamber lengths. A circuit die has control circuitry (e.g., an ASIC) to control piezo-actuator drive transistors. Part of the circuit die's surface forms the floor of the pressure chambers and includes inlet and outlet holes through which ink enters and exits the chambers.

In one embodiment, a piezoelectric inkjet die stack includes a substrate die, a circuit die stacked on the substrate die, a piezoelectric actuator die stacked on the circuit die, and a cap die stacked on the piezoelectric actuator die. Each die in the stack from the substrate die to the cap die is narrower than the previous die.

In another embodiment, a piezoelectric inkjet printhead includes a pressure chamber formed in a piezoelectric actuator die. A roof to the pressure chamber includes a membrane and a piezoelectric actuator on the membrane. A circuit die is adhered to the actuator die and forms a floor to the pressure chamber that is opposite the roof. Control circuitry (e.g., an ASIC) is fabricated on the circuit die at the floor of the pressure chamber to controllably flex the membrane by activating the piezoelectric actuator.

Illustrative Embodiments

FIG. 1 illustrates a fluid ejection device embodied as an inkjet printing system 100 suitable for incorporating a fluid ejection assembly (i.e., printhead) having a silicon die stack as disclosed herein, according to an embodiment of the disclosure. In this embodiment, a fluid ejection assembly is disclosed as a fluid drop jetting printhead 114. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward a print medium 118 so as to print onto print media 118. Print media 118 can be any type of suitable sheet or roll material, such as paper, card stock, transparencies, polyester, plywood, foam board, fabric, canvas, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, ink supply assembly 104 supplies ink under positive pressure through an ink conditioning assembly 105 to inkjet printhead assembly 102 via an interface connection, such as a supply tube. Ink supply assembly 104 includes, for example, a reservoir, pumps and pressure regulators. Conditioning in the ink conditioning assembly 105 may include filtering, pre-heating, pressure surge absorption, and degassing. Ink is drawn under negative pressure from the printhead assembly 102 to the ink supply assembly 104. The pressure difference between the inlet and outlet to the printhead assembly 102 is selected to achieve the correct backpressure at the nozzles 116, and is usually a negative pressure between negative 1" and negative 10" of H2O. Reservoir 120 of ink supply assembly 104 may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

Electronic printer controller 110 typically includes a processor, firmware, software, one or more memory components including volatile and no-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic printer controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters from data 124. In one embodiment, electronic controller 110 includes temperature compensation and control module 126 stored in a memory of controller 110. Temperature compensation and control module 126 executes on electronic controller 110 (i.e., a processor of controller 110) and specifies the temperature that circuitry in the die stack (e.g., an ASIC) maintains for printing. Temperature in the die stack is controlled locally by on-die circuitry that includes temperature sensing resistors and heater elements in the pressure chambers of fluid ejection assemblies (i.e., printheads) 114. More specifically, controller 110 executes instructions from module 126 to sense and maintain ink temperatures within pressure chambers through control of temperature sensing resistors and heater elements on a circuit die adjacent to the chambers.

In one embodiment, inkjet printing system 100 is a drop-on-demand piezoelectric inkjet printing system with a fluid ejection assembly 114 comprising a piezoelectric inkjet (PIJ) printhead 114. The PIJ printhead 114 includes a multilayer MEMS die stack, where each die in the die stack is narrower than the die below. The die stack includes a thin film piezoelectric actuator ejection element and control and drive circuitry configured to generate pressure pulses within a pressure chamber that force ink drops out of a nozzle 116. In one implementation, inkjet printhead assembly 102 includes a single PIJ printhead 114. In another implementation, inkjet printhead assembly 102 includes a wide array of PIJ printheads 114.

Figure 2:
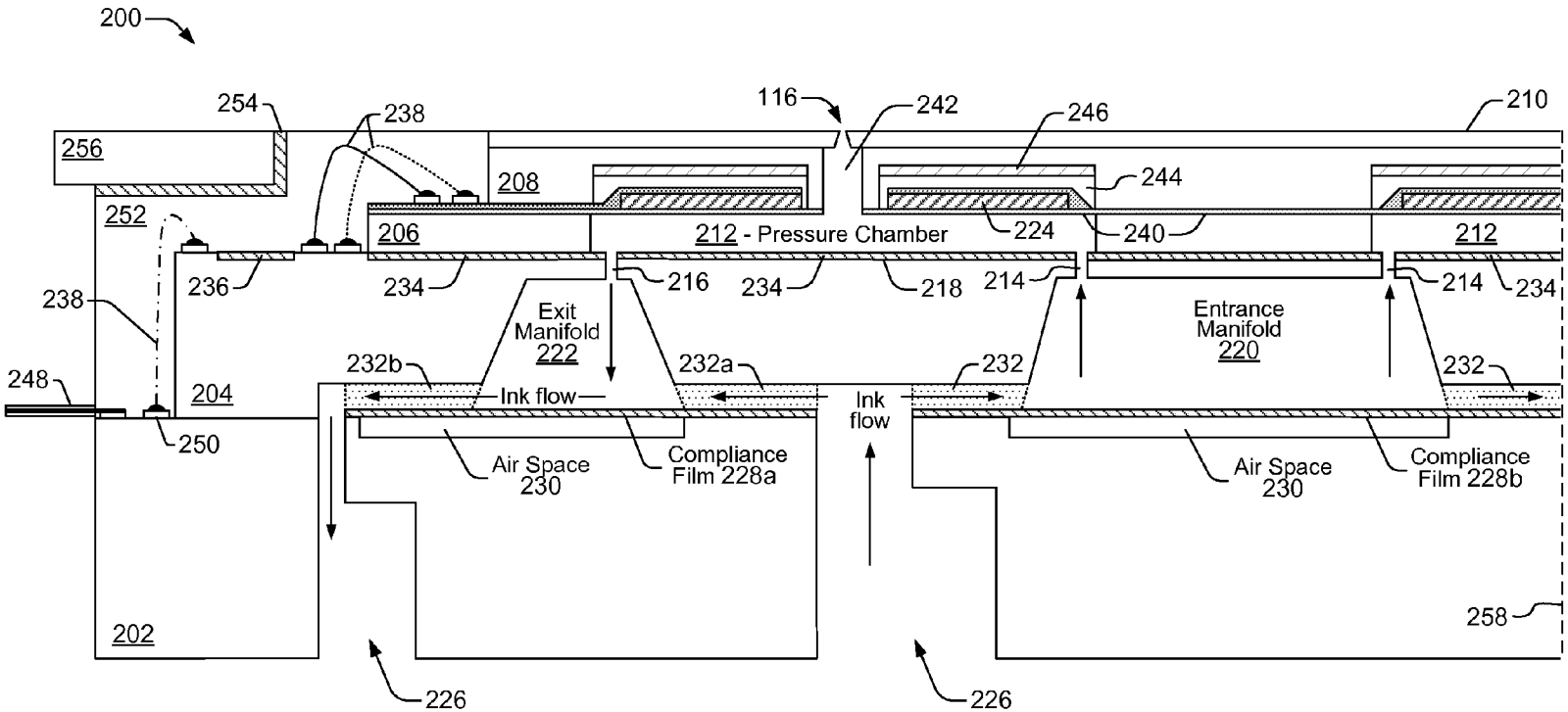
FIG. 2 shows a partial cross-sectional side view of an example piezoelectric die stack in a PIJ printhead, according to an embodiment.

FIG. 2 shows a partial cross-sectional side view of an example piezoelectric die stack 200 in a PIJ printhead 114, according to an embodiment of the disclosure. In general, the PIJ printhead 114 includes multiple die layers, each with different functionality. The overall shape of the die stack 200 is pyramidal, with each die in the stack being narrower than the die below (i.e., referencing die 202 of FIG. 2 as the bottom die). That is, each die starting with the bottom substrate die 202 gets successively narrower as they progress upward in the die stack toward the nozzle layer (nozzle plate) 210. In some embodiments, where extra space at the ends of the die is desired for alignment marks, trace routing, bond pads, fluidic passages, etc., a die in an above layer may also be shorter in length than the die below. The narrowing and/or shortening of the die from the bottom to the top of the die stack 200 creates a staircase effect on the sides (and sometimes the ends) of the die that enables die layers having circuitry to be connected via wire bonds between pads on the exposed stair steps.

The layers in the die stack 200 include a first (i.e., bottom) substrate die 202, a second circuit die 204 (or ASIC die), a third actuator/chamber die 206, a fourth cap die 208, and a fifth nozzle layer 210 (or nozzle plate). In some embodiments, the cap die 208 and nozzle layer 210 are integrated as a single layer. There is also usually a non-wetting layer (not shown) on top of the nozzle layer 210 that includes a hydrophobic coating to help prevent ink puddling around nozzles 116. Each layer in the die stack 200 is typically formed of silicon, except for the non-wetting layer and sometimes the nozzle layer 210. In some embodiments, the nozzle layer 210 may be formed of stainless steel or a durable and chemically inert polymer such as polyimide or SU8. The layers are bonded together with a chemically inert adhesive such as epoxy (not shown). In the illustrated embodiment, the die layers have fluid passageways such as slots, channels, or holes for conducting ink to and from pressure chambers 212. Each pressure chamber 212 includes two ports (inlet port 214, outlet port 216) located in the floor 218 of the chamber (i.e., opposite the nozzle-side of the chamber) that are in fluid communication with an ink distribution manifold (entrance manifold 220, exit manifold 222). The floor 218 of the pressure chamber 212 is formed by the surface of the circuit layer 204. The two ports (214, 216) are on opposite sides of the floor 218 of the chamber 212 where they pierce the circuit layer 204 die and enable ink to be circulated through the chamber by external pumps in the ink supply system 104. The piezoelectric actuators 224 are on a flexible membrane that serves as a roof to the chamber and is located opposite the chamber floor 218. Thus, the piezoelectric actuators 224 are located on the same side of the chamber 212 as are the nozzles 116 (i.e., on the roof or top-side of the chamber).

Referring still to FIG. 2, the bottom substrate die 202 comprises silicon, and it includes fluidic passageways 226 through which ink is able to flow to and from pressure chambers 212 via the ink distribution manifold (entrance manifold 220, exit manifold 222). Substrate die 202 supports a thin compliance film 228 configured to alleviate pressure surges from pulsing ink flows through the ink distribution manifold due to start-up transients and ink ejections in adjacent nozzles, for example. The compliance film 228 has a dampening effect on fluidic cross-talk between adjacent nozzles, as well as acting as a reservoir to ensure ink is available while flow is established from the ink supply during high volume printing. The compliance film 228 is on the order of 5-10 microns thick when it is made of a polymer such as polyester or PPS (polyphenylene sulfide). The compliance film 228 spans a gap in the substrate die 202 that forms a cavity or air space 230 on the backside of the compliance to allow it to expand freely in response to fluid pressure surges in the manifold. The air space 230 is typically, but not necessarily, vented to ambient. In either case, the air space 230 is configured so as not to be pressurized or to pull a vacuum which enables the compliance film 228 to readily move up and down into the air space 230 and absorb ink pressure surges. A typical gap between the compliance and the floor of the cavity 230 is between 100 and 300 microns. A similar clearance exists on the ink channel sides of the compliant film. A width between 1 mm and 2 mm provides sufficient compliance. If the compliant film is deposited, then thicknesses of 1-2 microns with widths less than 1 mm are possible. Compliant film 228*a* is narrower than compliant film 228*b* since compliant film 228*a* serves half as many ports (i.e., one outlet port 216) as compliant film 228*b* (i.e., two inlet ports 214).

Circuit die 204 is the second die in die stack 200 and is located above the substrate die 202. Circuit die 204 is adhered to substrate die 202 and it is narrower than the substrate die 202. In some embodiments, the circuit die 204 may also be shorter in length than the substrate die 202. Circuit die 204 includes the ink distribution manifold that comprises ink entrance manifold 220 and ink exit manifold 222. Entrance manifold 220 provides ink flow into chamber 212 via inlet port 214, while outlet port 216 allows ink to exit the chamber 212 into exit manifold 222. Circuit die 204 also includes fluid bypass channels 232 that permit some ink coming into entrance manifold 220 to bypass the pressure chamber 212 and flow directly into the exit manifold 222 through the bypass 232. As discussed in more detail below with respect to FIG. 3, bypass channel 232 includes an appropriately sized flow restrictor that narrows the channel so that desired ink flows are achieved within pressure chambers 212 and so sufficient pressure differentials between chamber inlet ports 214 and outlet ports 216 are maintained.

Circuit die 204 also includes CMOS electrical circuitry 234 implemented in an ASIC 234 and fabricated on its upper surface adjacent the actuator/chamber die 206. ASIC 234 includes ejection control circuitry that controls the pressure pulsing (i.e., firing) of piezoelectric actuators 224. At least a portion of ASIC 234 is located directly on the floor 218 of the pressure chamber 212. Because ASIC 234 is fabricated on the chamber floor 218, it can come in direct contact with ink inside pressure chamber 212. However, ASIC 234 is buried under a thin-film passivation layer (not shown) that includes a dielectric material to provide insulation and protection from the ink in chamber 212. Included in the circuitry of ASIC 234 are one or more temperature sensing resistors (TSR) and heater elements, such as electrical resistance films. The TSR's and heaters in ASIC 234 are configured to maintain the temperature of the ink in the chamber 212 at a desired and uniform level that is favorable to ejection of ink drops through nozzles 116. In one embodiment, the set temperature of the TSR's and heaters in ASIC 234 is specified by the temperature compensation and control module 126 executing on controller 110 to sense and adjust ink temperature within pressure chambers 212. If the ink is to be at an elevated temperature entering the printhead assembly 102, the temperature control module 126 will engage the pre-heater within the ink conditioning assembly 105.

Circuit die 204 also includes piezoelectric actuator drive circuitry/transistors 236 (e.g., FETs) fabricated on the edge of the die 204 outside of bond wires 238 (discussed below). Thus, drive transistors 236 are on the same circuit die 204 as the ASIC 234 control circuits and are part of the ASIC 234. Drive transistors 236 are controlled (i.e., turned on and off) by control circuitry in ASIC 234. The performance of pressure chamber 212 and actuators 224 is sensitive to changes in temperature, and having the drive transistors 236 out on the edge of circuit die 204 keeps heat generated by the transistors 236 away from the chamber 212 and the actuators 224.

The next layer in die stack 200 located above the circuit die 204 is the actuator/chamber die 206 ("actuator die 206", hereinafter). The actuator die 206 is adhered to circuit die 204 and it is narrower than the circuit die 204. In some embodiments, the actuator die 206 may also be shorter in length than the circuit die 204. Actuator die 206 includes pressure chambers 212 having chamber floors 218 that comprise the adjacent circuit die 204. As noted above, the chamber floor 218 additionally comprises control circuitry such as ASIC 234 fabricated on circuit die 204 which forms the chamber floor 218. Actuator die 206 additionally includes a thin-film, flexible membrane 240 such as silicon dioxide, located opposite the chamber floor 218 that serves as the roof of the chamber. Above and adhered to the flexible membrane 240 is piezoelectric actuator 224. Piezoelectric actuator 224 comprises a thin-film piezoelectric material such as a piezo-ceramic material that stresses mechanically in response to an applied electrical voltage. When activated, piezoelectric actuator 224 physically expands or contracts which causes the laminate of piezoceramic and membrane 240 to flex. This flexing displaces ink in the chamber generating pressure waves in the pressure chamber 212 that ejects ink drops through the nozzle 116. In the embodiment shown in FIG. 2, both the flexible membrane 240 and the piezoelectric actuator 224 are split by a descender 242 that extends between the pressure chamber 212 and nozzle 116. Thus, piezoelectric actuator 224 is a split piezoelectric actuator 224 having a segment on each side of the chamber 212. In some embodiments, however, the descender 242 and nozzle 116 are located at one side of the chamber 212 such that the piezoelectric actuator 224 and membrane 240 are not split.

Cap die 208 is adhered above the actuator die 206. The cap die 208 is narrower than the actuator 206, and in some embodiments it may also be shorter in length than the actuator die 206. Cap die 208 forms a cap cavity 244 over piezoelectric actuator 224 that encapsulates the actuator 224. The cavity 244 is a sealed cavity that protects the actuator 224. Although the cavity 244 is not vented, the sealed space it provides is configured with sufficient open volume and clearance to permit the piezoactuator 224 to flex without influencing the motion of the actuator 224. The cap cavity 244 has a ribbed upper surface 246 opposite the actuator 224 that increases the volume of the cavity and surface area (for increased adsorption of water and other molecules deleterious to the thin film pzt long term performance). The ribbed surface 246 is designed to strengthen the upper surface of the cap cavity 244 so that it can better resist damage from handling and servicing of the printhead (e.g., wiping). The ribbing helps reduce the thickness of the cap die 208 and shorten the length of the descender 242.

Cap die 208 also includes the descender 242. The descender 242 is a channel in the cap die 208 that extends between the pressure chamber 212 and nozzle 116, enabling ink to travel from the chamber 212 and out of the nozzle 116 during ejection events caused by pressure waves from actuator 224. As noted above, in the FIG. 2 embodiment, the descender 242 and nozzle 116 are centrally located in the chamber 212, which splits the piezoelectric actuator 224 and flexible membrane 240 between two sides of the chamber 212. Nozzles 116 are formed in the nozzle layer 210, or nozzle plate. Nozzle layer 210 is adhered to the top of cap die 208 and is typically the same size (i.e., length and width, but not necessarily thickness) as the cap die 208.

FIG. 2 shows only a partial (i.e., left side) cross-sectional view of die stack 200 in a PIJ printhead 114. However, the die stack 200 continues on toward the right side, past the dashed line 258 shown in FIG. 2. In addition, the die stack 200 is symmetrical, and it therefore includes features on its right side (not shown in FIG. 2) that mirror the features shown on its left side in FIG. 2. For example, the ink entrance manifold 220 and ink exit manifold 222 shown in FIG. 2 on the left side of die stack 200 are mirrored on the right side of the die stack 200, which is not shown in FIG. 2. Additional features of the ink distribution manifold, such as the mirrored entrance and exit manifolds, are shown in FIG. 3.

Figure 3:
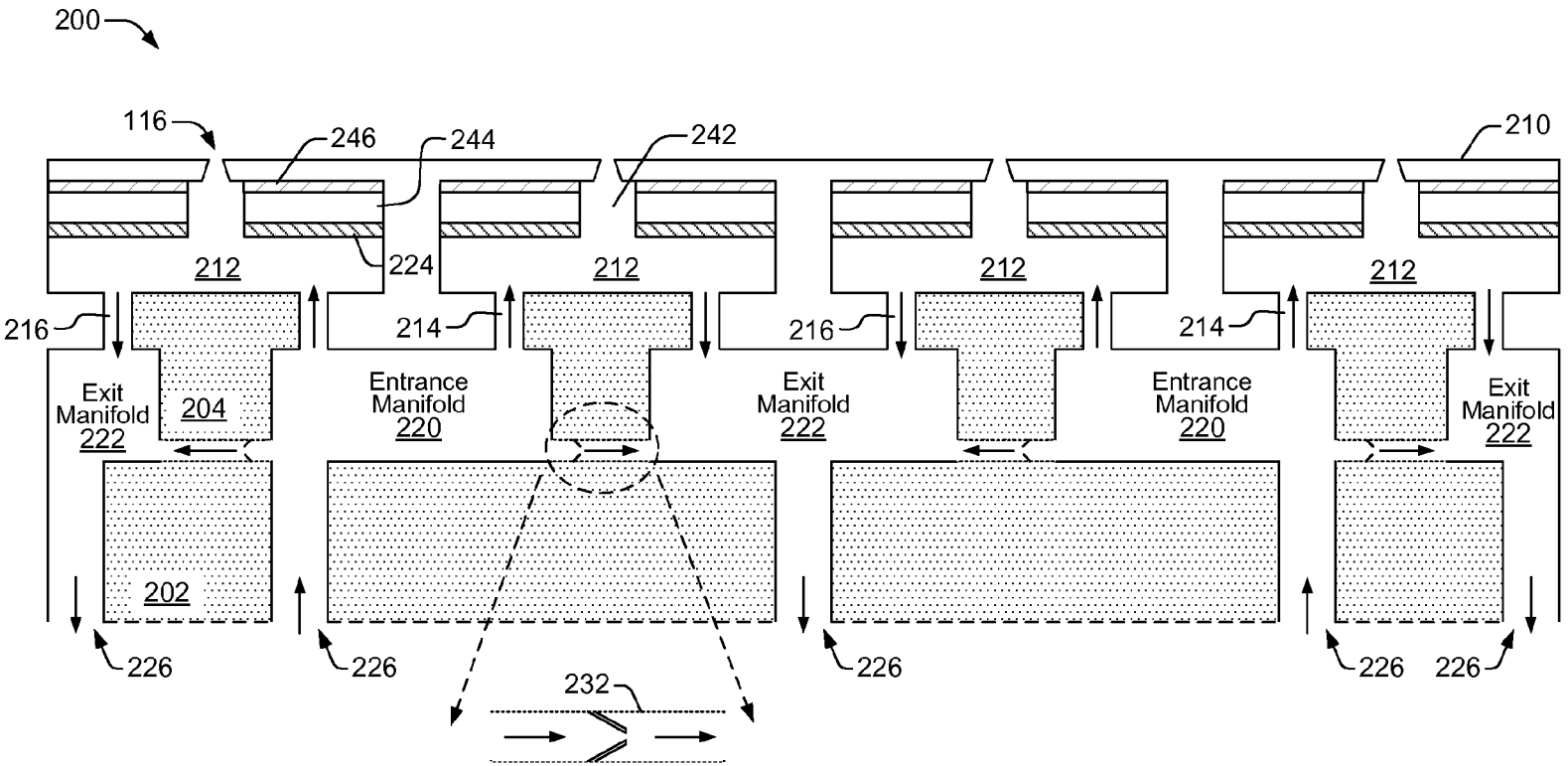
FIG. 3 shows a cross-sectional side view of an example piezoelectric die stack in a PIJ printhead, according to an embodiment

FIG. 3 shows a cross-sectional side view of an example piezoelectric die stack 200 in a PIJ printhead 114, according to an embodiment of the disclosure. For the sake of discussion, many of the features described above with reference to FIG. 2 are not included in the illustration or discussion of the die stack 200 shown in FIG. 3. FIG. 3 shows a full cross-sectional side view of die stack 200 but is primarily intended to illustrate additional manifolds, chambers and nozzles, as they appear across the width of an example die stack 200 such as in the embodiment discussed above regarding FIG. 2. In the die stack 200 of FIG. 3, there are four rows of pressure chambers 212 and corresponding nozzles 116 across the width of the die stack 200. Five fluidic passageways 226 through the substrate die 202 channel ink (e.g., from ink supply system 104) to and from five corresponding manifolds in circuit die 204. More specifically, three exit manifolds 222, two at the edges of the die stack 200 and one at the center of the die stack 200, channel ink out of the pressure chambers 212 in die stack 200. The three exit manifolds 222 provide channels for ink to exit the four pressure chambers 212 (i.e., four rows of pressure chambers) through four corresponding outlet ports 216 in the chambers 212. Two entrance manifolds 220 within the die stack provide channels for ink to enter the four pressure chambers 212 (i.e., four rows of pressure chambers) through four corresponding inlet ports 214 in the chambers 212.

Also shown in the die stack 200 of FIG. 3, are fluid bypass channels 232 (e.g., 232*a*, 232*b*) formed in circuit die 204. As mentioned above, bypass channels 232 allow a portion of ink coming into an entrance manifold 220 to flow directly into an exit manifold 222 through the bypass 232 without first passing through a pressure chamber 212. Each bypass channel 232 includes a flow restrictor 300 that effectively narrows the channel to restrict the flow of ink from the entrance manifold 220 to the exit manifold 222. The restriction caused by a flow restrictor 300 in bypass channel 232 helps to achieve appropriate flow within the pressure chamber 212. The flow restrictor 300 also helps to maintain sufficient pressure differentials between chamber inlet ports 214 and outlet ports 216. It is noted that the flow restrictor 300 shown in FIG. 3 is only for the purpose of discussion and is not necessarily intended to illustrate a physical representation of an actual flow restrictor. Actual flow restriction is established by controlling the length and width of the bypass channels themselves (e.g., 232*a* and 232*b*). Thus, for example, the length and width of bypass channel 232*a* may vary from the length and width of bypass channel 232*b* in order to achieve different levels of flow through the channels and pressures in chambers 212.

Figure 4:
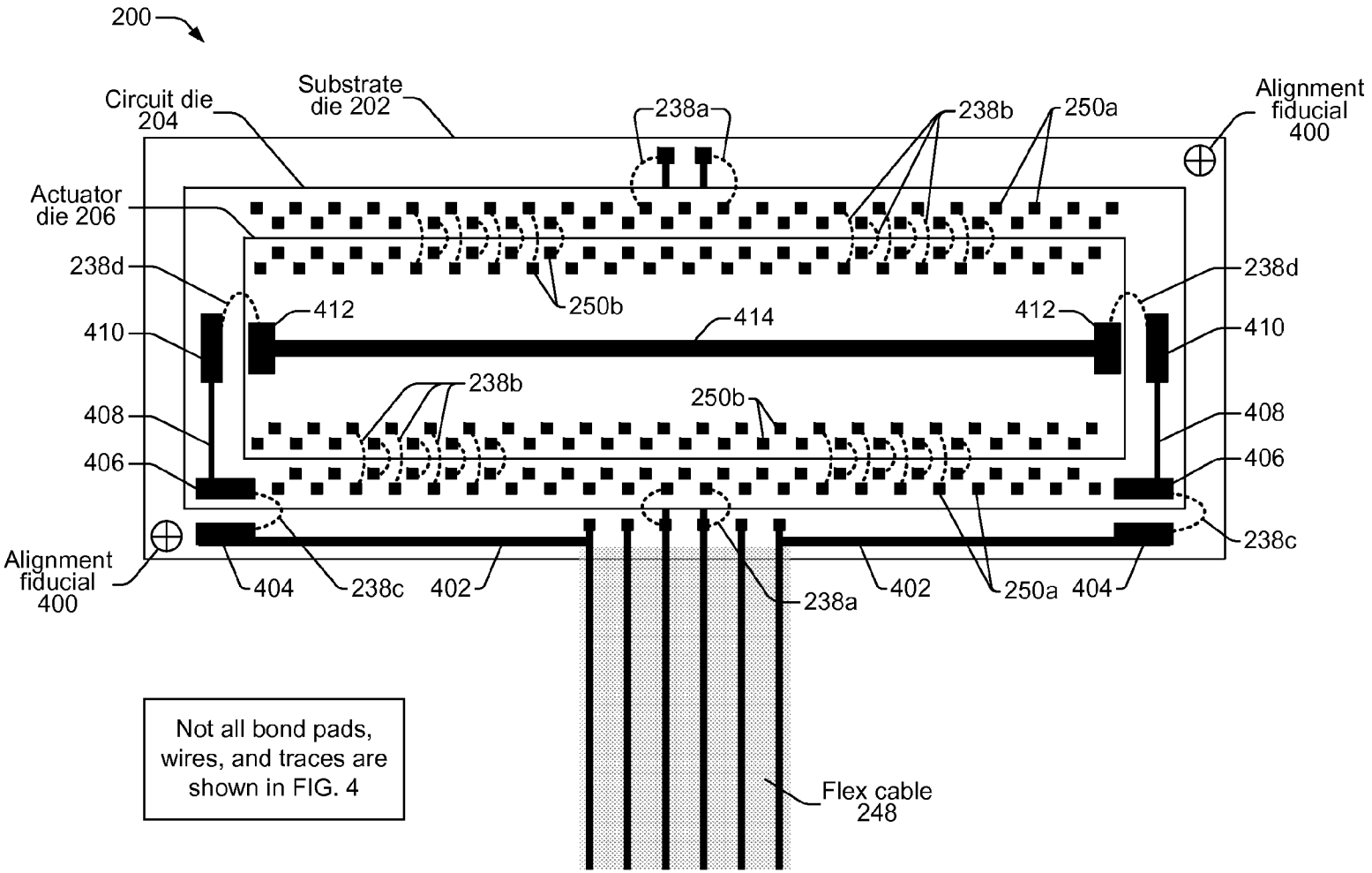
FIG. 4 shows a top down view of die layers in an example piezoelectric die stack, according to an embodiment.

FIG. 4 shows a top down view of die layers in an example piezoelectric die stack 200, according to an embodiment of the disclosure. In the die stack 200 of FIG. 4, the substrate die 202 is shown at the bottom of the stack, with a smaller (i.e., narrower and shorter) circuit die 204 on top of the substrate die 202. On top of the circuit die 204 is a smaller (i.e., narrower and shorter) actuator die 206. Alignment fiducials 400 are shown at corner edges of the substrate die 202. Referring generally to FIGS. 4 and 2, the progressively smaller dies create a pyramidal or stair-step shaped die stack 200 that provides room at the die edges to make the alignment fiducials 400 visible, an increased number of bond pads 250 and wires 238, and trace routing between bond pads 250 (not all bond pads, wires, and traces are shown). The additional space at the die edges also supports encapsulant 252 to protect the wires 238 and bond pads 250 from damage, and generally enables a straightforward alignment and interconnection during assembly to ensure proper vertical fitting of manifold compliances, drive electronics, and multiple ink feeds. Having the circuit die 204 adjacent (i.e., directly below) the actuator die 206 enables a shortened length for wires 238, which reduces damage during manufacturing and lessens the amount of exposed material to protect by encapsulation. The extra surface area at the die edges also provides room for a sealant 254 between a protective shroud 256 and the die stack 200. The sealant 254 reduces the chance that ink will penetrate into electrical connections in the die stack 200.

Referring still to FIGS. 2 and 4, the flex cable 248 is shown as being connected to die stack 200 at a side edge of a surface of the substrate die 202. However, in other embodiments flex cable 248 may be coupled to another die layer in die stack 200, such as the circuit die 204. Flex cable 248 includes on the order of 30 lines that carry low voltage, digital control signals from a signal source such as controller 110, power from a power supply 112, and ground. Serial digital control signals received via lines in flex cable 248 are converted (multiplexed) by control circuitry in ASIC 234 on circuit die 204 into parallel, analog actuation signals that switch drive transistors 236 on and off, activating individual piezoelectric actuators 224. Accordingly, a relatively small number of wires (e.g., wires 238*a*) are attached from the substrate die 202 to the circuit die 204 to carry serial control signals and power from the flex cable 248 to ASIC control circuitry and drive transistors 236 on circuit die 204. However, a much greater number of wires (e.g., wires 238*b*) are attached between bond pads 250*a* of circuit die 204 and corresponding bond pads 250*b* of actuator die 206 to carry the many parallel control signals from ASIC 234 on circuit die 204, along individual wires 238*b*, to individual piezoelectric actuators 224 (not shown in FIG. 4) on actuator die 206. Note that not all wires 238*b* between bond pads 250*a* and 250*b* have been illustrated in FIG. 4 and that the wires 238*b* shown are only a representative example. In this embodiment, bond pad densities may be as high as 200 pads per row per inch with two offset rows having as many as 400 pads per inch.

In one embodiment as shown in FIG. 4, ground traces 402 emanate from the flex cable 248 and extend along one side edge of the substrate die 202 to ground pads 404. Wires 238*c* are bonded to ground pads 404 and extend up to ground pads 406 on the adjacent circuit die 204 above. Ground traces 408 run from ground pads 406 along the two end edges of the circuit die 204 to ground pads 410 located on the end edges at the center of circuit die 204. Wires 238*d* are bonded to ground pads 410 on circuit die 204 and extend up to ground pads 412 on the center, end edges of actuator die 206. Ground bus 414 runs down the center of actuator die 206 between the opposite end edges of the die 206. Thus, the ground coming from flex cable 248 is initially coupled to the die stack 200 on substrate die 202, and routed up to the actuator die 206 along the side and end edges of substrate die 202 and circuit die 204. From the center ground bus 414, ground traces extend outward toward the side edges of the actuator die 206 to connect with piezoelectric actuators 224 (not shown in FIG. 4) as discussed below with respect to FIGS. 5 and 6.

Figure 5:
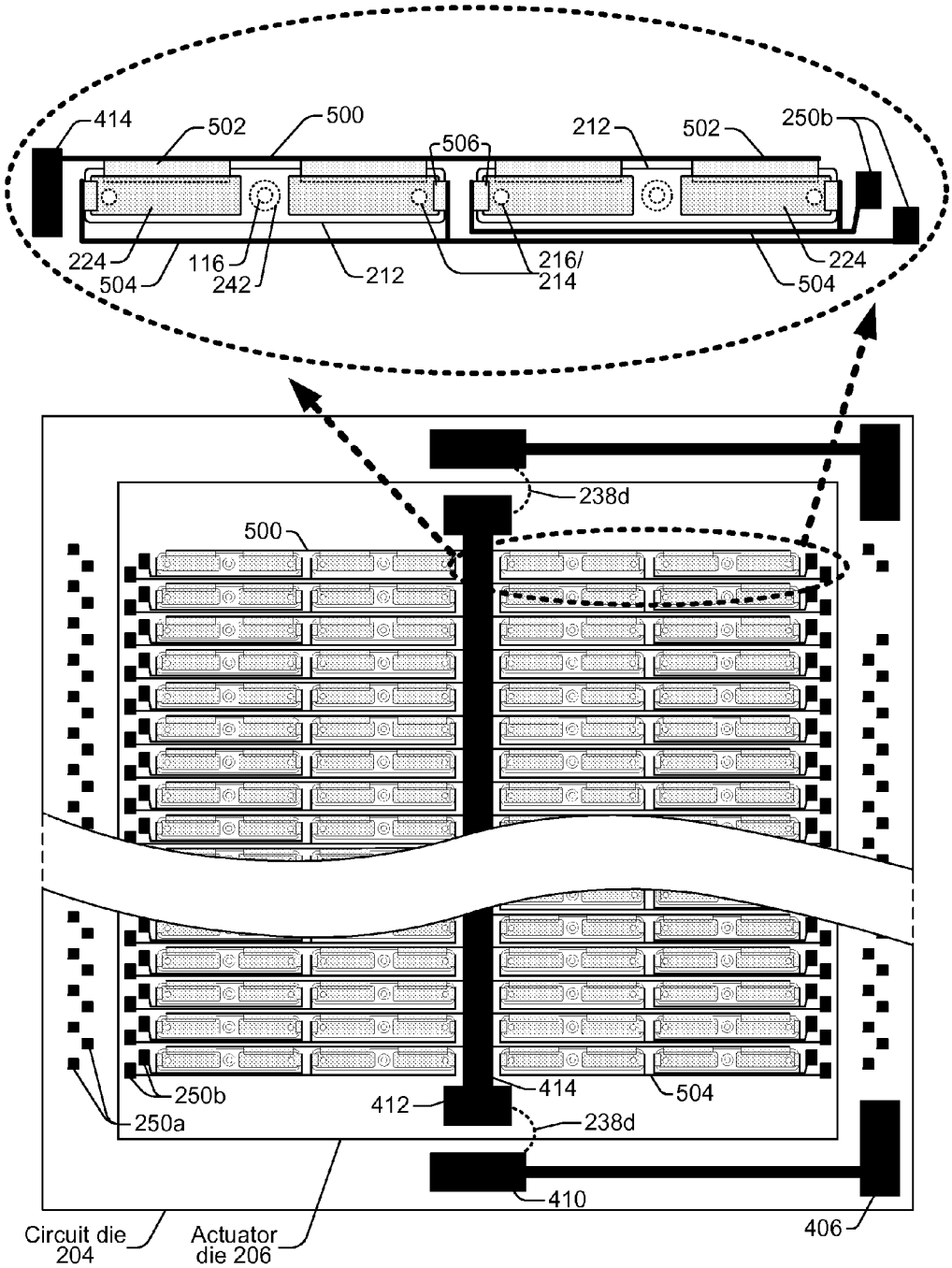
FIG. 5 shows a top down view of a partial die stack including an actuator die on top of a circuit die, according to an embodiment.

FIG. 5 shows a top down view of a partial die stack 200 including an actuator die 206 on top of a circuit die 204, according to an embodiment of the disclosure. Shown on the actuator die 206 are wire bond pads 250*b* running along both of the long side edges of the die 206. The space on the die 206 between the bond pads 250*b* has at least four rows of piezoelectric actuators 224. In other embodiments, however, the number of rows of actuators 224 may be increased, for example, to six, eight, or more rows. In this embodiment, ground connections made at both ends of the central ground bus 414 (i.e., via wires 238*d* from the circuit die 204) keep the resistance along the bus below an acceptable maximum level while helping to minimize the bus width. As shown in FIG. 5, ground traces 500 emanate from the central ground bus 414 and extend outward toward the two side edges of the actuator die 206. Thus, the ground traces 500 are "inside-out" ground traces that run between the rows of actuators and provide ground connections from the central ground bus 414 to each actuator 224. The ground connections 502 from the ground traces 500 are typically (but not necessarily) made to the bottom electrodes on the piezoceramic actuators 224. Drive signal traces 504 emanate from the bond pads 250*b* at the side edges of the actuator die 206 and extend inward toward the center of the die 206. Thus, the drive traces 504 are "outside-in" drive traces that run between the rows of actuators, with each drive trace 504 providing drive signals that activate a piezoceramic actuator 224. The drive trace connections 506 from drive traces 504 are typically (but not necessarily) made to the top electrodes on the piezoceramic actuators 224.

The trace layout with the "inside-out" ground traces 500 and "outside-in" drive traces 504 enables a tighter packing scheme for the traces which allows for more rows of actuators 224 in different embodiments. In addition, the trace layout enables the ground traces and drive traces to be on the same fabrication level, or within the same or common fabrication plane. That is, during fabrication, the same patterning and deposition processes used to put down the drive traces are also used to put down the ground traces at the same time. This eliminates process steps as well as eliminating the insulation layer between the drive traces and ground traces.

Also shown on the actuator die 206 of FIG. 5, are pressure chambers 212, outlines to the inlet and outlet ports (214, 216) in the underlying circuit die 204, and outlines for descenders 242 and nozzles 116 that are in the overlying cap die 208 and nozzle layer 210, respectively. In the embodiments of FIG. 5 and FIG. 2, each chamber 212 has a split actuator 224. The actuators 224 are split into two segments by the descenders 242 and nozzles 116 that are located in the middle of the chamber. In this design, both segments of the split actuator 224 are coupled to a ground trace 500 and a drive trace 504. The tight packing scheme for the trace layout having the "inside-out" ground traces 500 and "outside-in" drive traces 504 better accommodates such a split actuator design.

Figure 6:
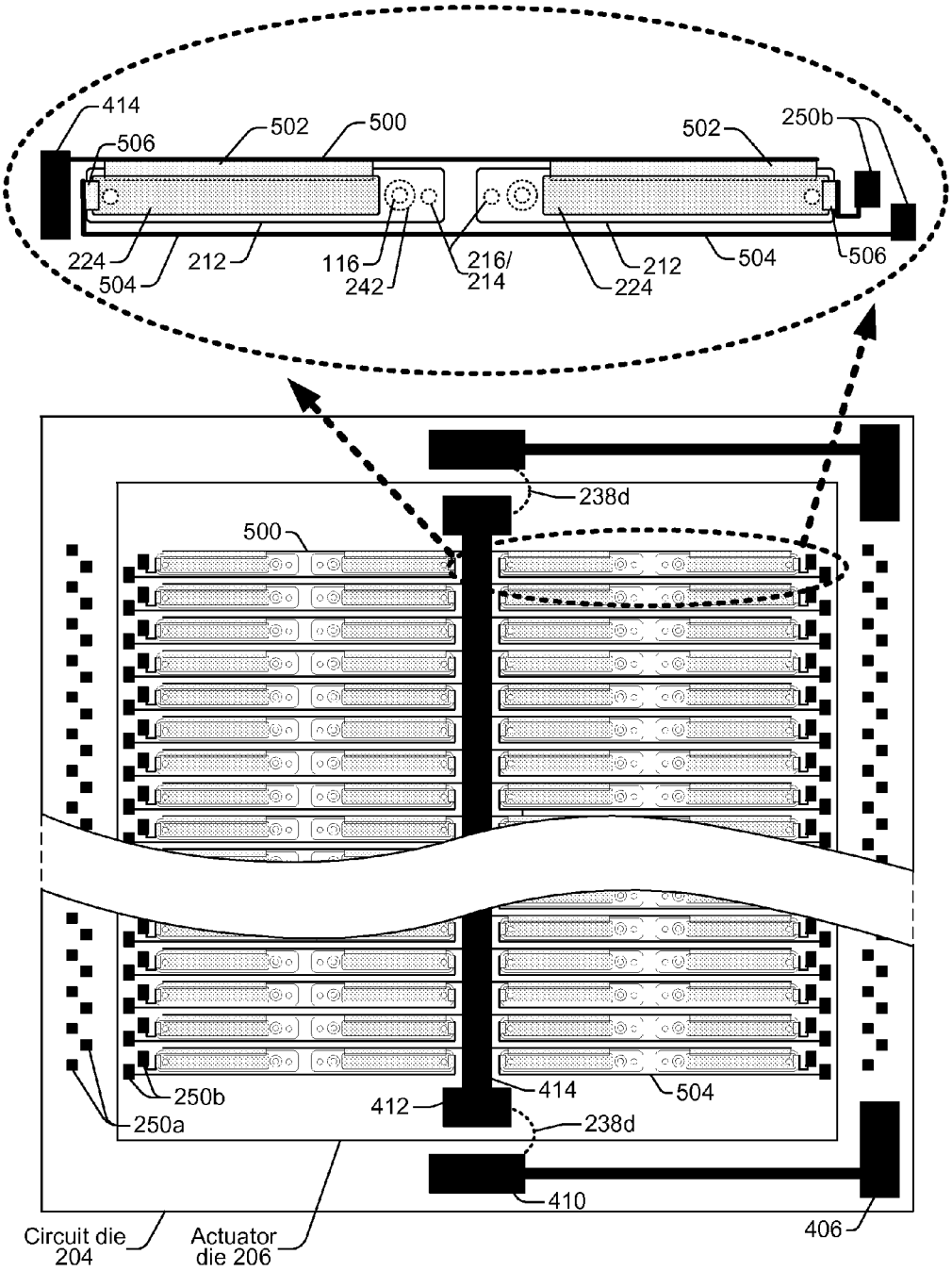
FIG. 6 shows a top down view of a partial die stack including an actuator die having actuators that are not split actuators, according to an embodiment.

FIG. 6 shows a top down view of a partial die stack 200 including an actuator die 206 having actuators 224 that are not split, according to an embodiment of the disclosure. In this embodiment, the descender 242 and nozzle 116 are located to one side of the chamber 212 rather than in the middle of the chamber 212 as in the split actuator design in the FIG. 5 embodiment. This enables a single actuator 224 to span the width of the chamber 212 as a single element. This design therefore has half as many ground trace 500 and drive trace 504 connections being made to actuators 224 as in the split actuator design of FIG. 5. Accordingly, there are fewer traces taking up space in between the rows of actuators on the actuator die 206.

Figure 7:
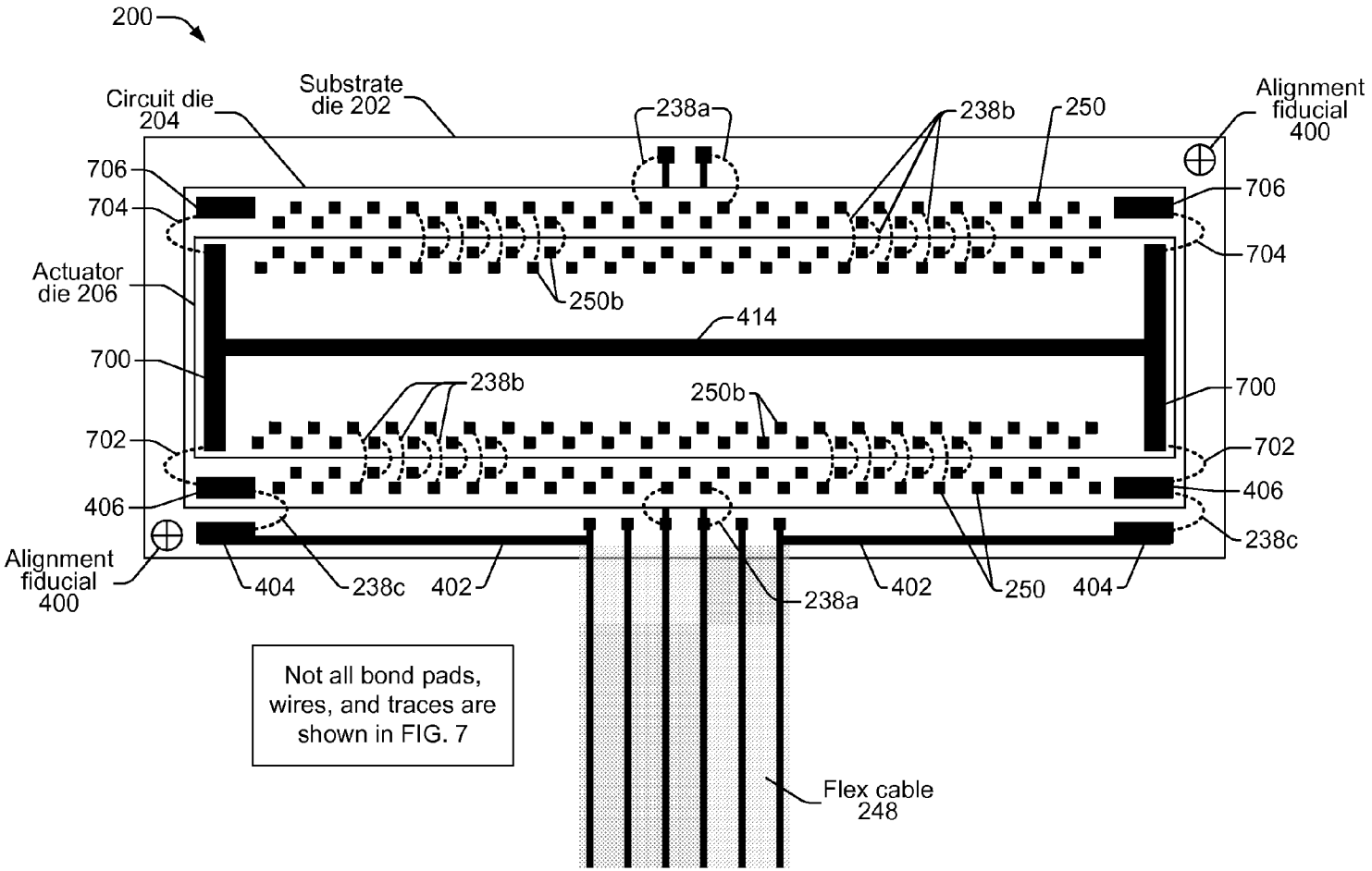
FIG. 7 shows a top down view of die layers in an example piezoelectric die stack with an alternate trace layout, according to an embodiment.

FIG. 7 shows a top down view of die layers in an example piezoelectric die stack 200, according to an embodiment of the disclosure. FIG. 7 is similar to FIG. 4 discussed above, except that the illustrated embodiment shows an alternate layout for routing the ground connections from the flex cable 248 on the substrate die 202 up to the center ground bus 414 on the actuator die 206. In this embodiment, the center ground bus 414 includes a perpendicular segment 700 on each end of the bus 414. The perpendicular segments 700 extend perpendicularly away from the ends of the bus 414 in two directions toward the two side edges of the actuator die. The perpendicular segments 700 facilitate ground connections to the center ground bus 414 in different implementations of the die stack 200, such as when the circuit die 204 and actuator die 206 have the same length, or are closer to the same length than in previously discussed embodiments. In such implementations there may not be enough space at end edges of the circuit die 204 to place bond or ground pads, or to run ground traces. This would prevent the particular ground routing scheme shown in FIG. 4 that connects ground to the center ground bus 414 on the actuator die 206 from the circuit die 204. Thus, the FIG. 7 embodiment provides an alternate routing of ground connections from the flex cable 248 up to the center ground bus 414 on the actuator die 206 in implementations where there may be insufficient space at the end edges of the circuit die 204.

In the embodiment of FIG. 7, ground traces 402 emanate from the flex cable 248 and extend along one side edge of the substrate die 202 to ground pads 404. Wires 238*c* are bonded at one end to ground pads 404 and extend up to the circuit die 204 where they are bonded at the other end to ground pads 406. From ground pads 406 on circuit die 204, wires 702 are bonded up to the perpendicular extensions 700 on the end edges of the actuator die 206, providing ground connection to the center ground bus 414. In some embodiments, the perpendicular extensions 700 on actuator die 206 may also be used to provide ground connection to the other side edge of the circuit die 204. In such cases, as shown in FIG. 7, wires 704 are bonded to the other side of the perpendicular extensions 700 and extended back down to the other side edge of circuit die 204 where they are bonded to ground pads 706. Thus, in addition to providing alternate routing of ground connections from the flex cable 248 up to the center ground bus 414 on the actuator die 206, perpendicular extensions 700 to the center ground bus 414 also enable ground connections from one side of the circuit die 204 to the other side, over the actuator die 206. These alternate ground trace routings are particularly useful in die stack 200 implementations where there may be insufficient space at the end edges of the circuit die 204, such as when the circuit die 204 and actuator die 206 have the same or similar lengths.

Referring generally to FIGS. 4-7, in alternate embodiments the roles of the central ground bus and the individual drive traces can be reversed. Thus, the ground bus 414 is instead at peak drive voltage. Accordingly, with respect to FIG. 4 for example, in such alternate embodiments the previously described ground traces 402 emanating from flex cable 248 and extending along the side edge of substrate die 202 would instead be peak drive voltage traces. Likewise, ground pads 404, 406, 410 and 412, and wires 238*c* and 238*d* would carry peak drive voltage instead of ground. Thus, drive voltage traces (rather than ground traces) would extend outward from the central bus 414 toward the side edges of the actuator die 206 to connect with piezoelectric actuators 224. Furthermore, the piezoelectric actuators 224 are connected to ground by the individual parallel traces 504, through the bond pads 250*b* at the side edges of the actuator die 206, and then by the drive transistors 236. Through this trace path embodiment, drive transistors 236 alternately disconnect and connect the piezoelectric actuators 224 to ground to activate the actuators 224. Thus, in such alternate embodiments, the drive traces are "inside-out" drive traces that run from the central bus 414 to each actuator 224 between the rows of actuators to provide drive voltages that activate piezoceramic actuators 224, while the ground traces are "outside-in" ground traces that run between the rows of actuators to provide ground connections to each actuator 224 through drive transistors 236.

What is claimed is:

1. A piezoelectric inkjet die stack comprising:
a circuit die stacked on a substrate die;
a piezoelectric actuator die stacked on the circuit die; and
a cap die stacked on the piezoelectric actuator die;
wherein each die in succession from the circuit die to the cap die is narrower than a previous die.

2. A die stack as in claim 1, wherein an additional die is interposed in the stack that has a width the same as or wider than the die above it in the stack.

3. A die stack as in claim 1, further comprising a fluid passageway extending through each die to enable fluid flow from the substrate die to the cap die and back.

4. A die stack as in claim 3, wherein the fluid passageway comprises:
two exit manifolds opposite one another at edges of the die stack;
two entrance manifolds opposite one another between the edges and the center of the die stack; and
one exit manifold at the center of the die stack.

5. A die stack as in claim 1, further comprising:
a pressure chamber in the piezoelectric actuator die;
an entrance manifold and inlet port in the circuit die to supply ink to the pressure chamber;
an exit manifold and outlet port in the circuit die to allow ink to exit the pressure chamber; and
a bypass channel between the entrance and exit manifolds to enable ink to bypass the pressure chamber.

6. A die stack as in claim 5, wherein the bypass channel comprises a flow restrictor to restrict the flow of ink.

7. A die stack as in claim 1, further comprising:
a cap cavity in the cap die to protect a piezoelectric actuator; and
a ribbed upper surface in the cap cavity opposite the piezoelectric actuator.

8. A die stack as in claim 4, further comprising:
a compliance film spanning a gap in the substrate die and forming a vented air space, the compliance film configured to flex into the air space during an ink pressure surge within an entrance manifold.

9. A die stack as in claim 1, further comprising:
a pressure chamber in the piezoelectric actuator die; and
a floor to the pressure chamber that comprises an application specific integrated circuit (ASIC) control circuit.

10. A die stack as in claim 9, wherein the pressure chamber comprises:
a flexible membrane roof opposite the floor; and
a piezoelectric actuator adjacent the roof to cause the flexible membrane to flex.

11. A die stack as in claim 10, further comprising a cavity formed in the cap die to seal the piezoelectric actuator.

12. A die stack as in claim 11, further comprising a ribbed upper surface of the cavity to provide strength to the cavity.

13. A die stack as in claim 9, further comprising:
a nozzle layer with a nozzle stacked on the cap die; and
a descender in the cap die opposite the floor of the pressure chamber to provide fluid communication between the pressure chamber and the nozzle.

14. A die stack as in claim 13, wherein the descender is centrally located in the chamber roof such that the piezoelectric actuator is a split actuator having a first actuator segment on one side of the descender and a second actuator segment on another side of the descender.

15. A die stack as in claim 9, further comprising a passivation layer covering the ASIC control circuit and configured to be in direct contact with ink in the pressure chamber.

16. A die stack as in claim 9, further comprising a temperature sensing resistor and a heater element as part of the ASIC control circuit to control ink temperature within the pressure chamber.

17. A die stack as in claim 9, wherein the ASIC control circuit is on the circuit die, the die stack further comprising drive transistors on an edge of the circuit die.

18. A die stack as in claim 9, further comprising:
a flex cable coupled to an edge of the substrate die;
wire bonds from the edge of the substrate die to the edge of the circuit die; and
wire bonds from the edge of the circuit die to the edge of the actuator die.

19. A piezoelectric inkjet printhead comprising:
a pressure chamber formed in a piezoelectric actuator die;
a roof to the pressure chamber comprising a membrane and a piezoelectric actuator on the membrane;
a circuit die adhered to the actuator die and forming a floor to the pressure chamber that is opposite the roof; and
control circuitry fabricated on the circuit die at the floor of the pressure chamber to controllably flex the membrane by activating the piezoelectric actuator.

20. A printhead as in claim 19, further comprising:
a descender located centrally in the roof such that the membrane and the actuator comprise a split membrane and a split actuator, respectively; and a nozzle opposite the pressure chamber at one end of the descender, the descender enabling fluid communication between the pressure chamber and the nozzle.

* * * * *